US006851484B2

(12) United States Patent
Klompien

(10) Patent No.: US 6,851,484 B2
(45) Date of Patent: Feb. 8, 2005

(54) WHEEL TRACK FILLING APPARATUS

(76) Inventor: Layne Klompien, 304 Blackwood Rd., Bozeman, MT (US) 59715-9107

( * ) Notice: Subject to any disclaimer, the term of this patent is extended or adjusted under 35 U.S.C. 154(b) by 0 days.

(21) Appl. No.: 10/245,930

(22) Filed: Sep. 17, 2002

(65) Prior Publication Data

US 2004/0050565 A1 Mar. 18, 2004

(51) Int. Cl.[7] ..... A01B 79/00

(52) U.S. Cl. ..... 172/191; 172/201; 172/605; 172/616; 172/684.5; 172/701; 172/735; 172/736; 172/742; 172/776

(58) Field of Search ..... 172/684.5, 701, 172/734–736, 741, 742, 744, 776, 19, 20, 799.5, 169, 170, 171, 174–176, 182, 183, 190, 191, 195–197, 199–203, 232, 810, 811, 605, 613–618, 439; 37/196, 214–222, 266–270, 272–276, 279, 281, 284, 285, 381

(56) References Cited

U.S. PATENT DOCUMENTS

| | | | | | |
|---|---|---|---|---|---|
| 1,186,365 | A | | 6/1916 | Allmon | |
| 1,317,602 | A | * | 9/1919 | Steele | 172/684.5 |
| 1,721,075 | A | * | 7/1929 | Hargleroad | 172/684.5 |
| 2,505,280 | A | | 4/1950 | Ellinghuysen | |
| 3,684,031 | A | * | 8/1972 | Reynolds | 172/686 |
| 4,059,911 | A | | 11/1977 | Bean et al. | 37/142.5 |
| 4,192,388 | A | | 3/1980 | Goebel | 172/463 |
| 4,209,068 | A | | 6/1980 | Corsentino | 172/572 |
| 4,262,752 | A | | 4/1981 | Parish | 172/574 |
| 4,283,867 | A | | 8/1981 | Brown | 37/142.5 |
| 4,601,347 | A | | 7/1986 | Parish | 172/134 |
| 4,909,334 | A | | 3/1990 | Tanner et al. | 172/58 |
| 5,095,997 | A | | 3/1992 | Warner et al. | 172/134 |
| 5,353,529 | A | | 10/1994 | McCullough | 37/142.5 |
| 5,427,185 | A | * | 6/1995 | Seal | 172/684.5 |
| 5,479,728 | A | | 1/1996 | Deken et al. | 37/142.5 |
| 5,845,717 | A | | 12/1998 | Gillespie | 172/833 |
| 2002/0108763 | A1 | * | 8/2002 | Knight et al. | 172/439 |

* cited by examiner

*Primary Examiner*—Christopher J. Novosad
(74) *Attorney, Agent, or Firm*—Pedersen & Co. PLLC; Ken J. Pedersen; Barbara S. Pedersen

(57) ABSTRACT

A novel and practical track-filling apparatus for smoothing rutted soil formed by the repeated passage of wheels. This apparatus includes a frame, a system for attaching the frame to a tractor, and a soil moving blade assembly mounted to the frame. This blade assembly has laterally disposed and spaced apart left and right blades. A system for adjusting the included blade angle between these blades is also provided. This system for adjusting includes a single blade adjusting hydraulic ram that is operatively connected to the blades via a novel yet simple and reliable linkage assembly. Additionally, systems for lifting and tilting the apparatus optimizes operation of this track-filling apparatus over irregular and differing terrain.

18 Claims, 5 Drawing Sheets

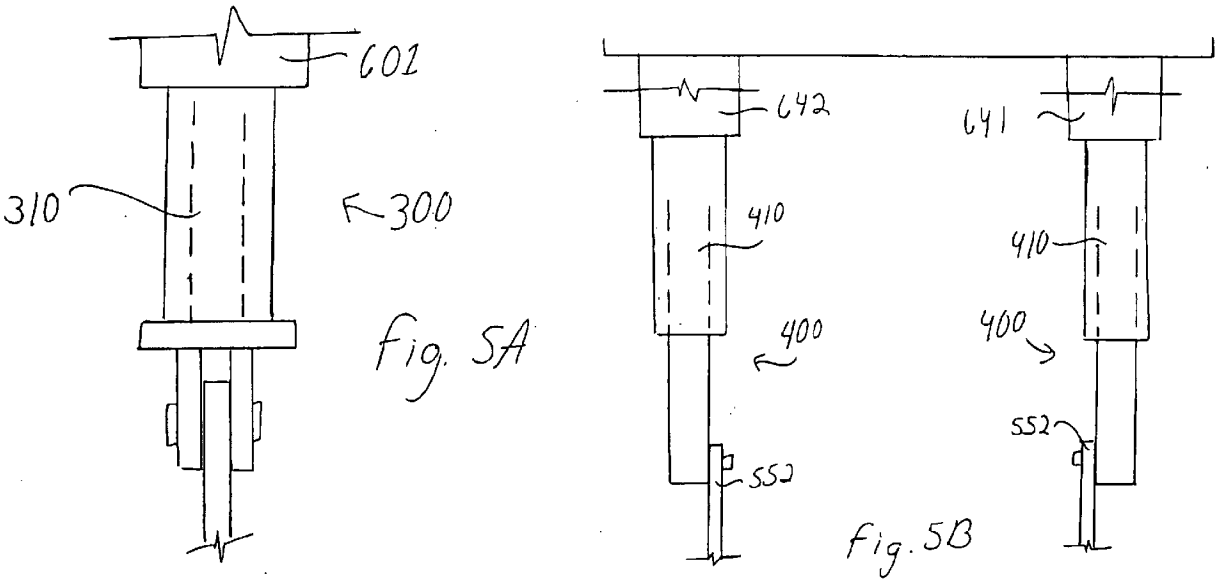
Fig. 5A
Fig. 5B
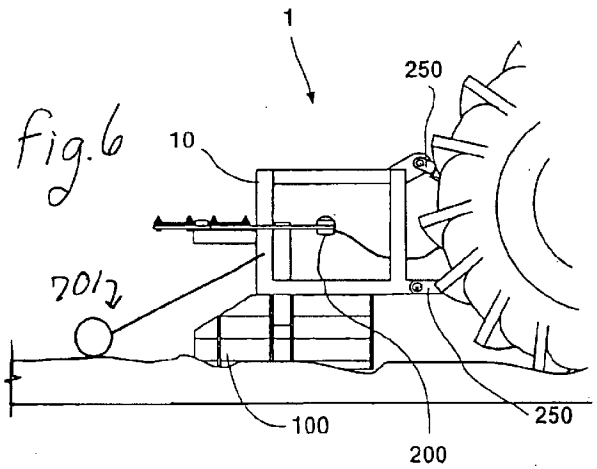
Fig. 6

WHEEL TRACK FILLING APPARATUS

BACKGROUND OF THE INVENTION

1. Field of the Invention

This invention relates to equipment for filling ruts and tracks and more specifically to ruts and tracks formed in soil by wheels of self powered, linear and center pivot agricultural irrigation systems.

2. Related Art

Manifold problems result from the ruts and tracks developed by wheels used in agricultural applications. Of specific concern is the long existing problem in farming operations of the tracks and ruts caused by, for example, the wheels of center pivot sprinkler irrigation systems. The weight supported by these wheels and the multiple passes each makes over the same track cause soil to be displaced to each side of the wheel thus forming deep tracks and ruts.

Such ruts and tracks are particularly disruptive to agricultural operations where they exist in areas that must be trafficked by other farm or ranch equipment, e.g. trucks and tractors. In addition to slowing field operations and potentially damaging running gear and suspension systems, ruts and tracks will collect rain and irrigation water to further impede equipment transport in the field. In agricultural fields that are not regularly tilled, the ruts and tracks will continually deepen over time and may even impair the operation of the irrigation equipment itself. Prior methods of restoring the irrigated field to a smooth and level condition required manual labor with shovels or the use of power driven equipment such as a scraper, grader, bulldozer or the like, all a slow and costly operation.

Because of the widespread extent of this problem, inventors have been particularly active its resolution. As will be reviewed in the following, all identified patent activity has centered around moving soil back into the rut or track by the use of disks, tillers or augers. These devices are either mounted directly on the irrigation device, attached to or pulled behind a farm tractor, or in some cases they are self-propelled. Some of these devices also include a means to compact or smooth the replaced soil.

Bean (U.S. Pat. No. 4,059,911), Goebel (U.S. Pat. No. 4,192,388), Corsentino (U.S. Pat. No. 4,209,068) and Parish (U.S. Pat. Nos. 4,262,752 and 4,601,347) describe devices that are integral with the irrigation apparatus. Although differing in substantial and important details, each inventor provides a pair of cooperating adjustable disks mounted adjacent to the wheels of an irrigation system. These disks engage the laterally displaced soil mounds on either side of the wheels and returns the soil to the region of the wheel track. Such systems offer the advantage of immediate and automatic restoration of the soil while the irrigation system is in operation. However, they add significant additional operational complexity to the irrigation apparatus and should they fail, the critical irrigation process could be jeopardized.

Tanner (U.S. Pat. No. 4,909,334) and McCullough (U.S. Pat. No. 5,353,529), describe self-propelled devices. Tanner provides a machine for smoothing ruts comprising a pair of powered rotary tillers. The tillers are rotated toward each other on either side of the rut. The rotating tillers move the displaced soil back into the region of the rut. A guide shoe between the tillers is provided to maintain the tillers in the proper working position. McCullough provides a frame having an engine, drive wheels and a powered auger to fill a trench. McCullough's invention is applied to the installation of residential sprinkler systems.

Several disclosures present devices for closing (filling) wheel tracks and ruts using equipment attached to or towed by a farm tractor. These devices incorporate either a convention disk, tilling devices and rotating augers. For example Gillespie (U.S. Pat. No. 5,845,717) describes a device mounted on a tractor comprising two sets of rotary disks. One set mounted in front of the front wheels of a tractor returns soil from one side of the track. The second set of disks placed behind the front wheels moves soil from the other side of the track. The rear wheels of the tractor are used to compact the returned soil over the track area. Warner (U.S. Pat. No. 5,095,997) presents a track eraser that is pulled behind a tractor. The eraser elements are like the tongs of a rake with penetration into the soil determined by the weight of the assembly supporting the rake elements. Brown (U.S. Pat. No. 4,283,867) horizontally mounts a pair of counter-rotating augers on the front of a tractor. The augers straddle the track path and when actuated move the displaced soil to cover the track. Deken (U.S. Pat. No. 5,479,728) describes a backfilling and tamping device for trenches that also includes rotating augers to return soil to the trench. This device is mounted integrally with the trenching and tamping equipment.

Although the above described inventions have significantly advanced the art of returning soil displaced from wheel tracks, trenches and the like, they incorporate either complex and potentially hazardous rotary power equipment (e.g. augers and rotary tillers) or are disks which are difficult to control and may not be as effective as the task requires. Other devices are attached directly to the source of the wheel tracks (e.g. irrigation sprinkler systems) thus potentially limiting their effectiveness and reducing reliability.

The apparatus disclosed herein offers substantial improvements over the prior art by the incorporation of a novel soil moving concept and implementing apparatus. Thus it is an object of this invention to provide apparatus for efficiently, effectively and safely restoring soil to a smooth condition after it has suffered tracking and rutting from repeated passage of wheels, particularly wheels as incorporated in linear and center pivot sprinkler irrigation systems. It is a further object of this invention to provide a variety of easily controlled means to optimize the performance of the equipment based on the soil and terrain conditions encountered during the restoration operation. It is yet another object of this invention to provide an apparatus that is inexpensive to fabricate yet is operationally durable and reliable. It is yet another object of this invention to provide a track filling apparatus that is easily and quickly attached to and removed from a conventional farm tractor.

SUMMARY OF THE INVENTION

Ruts and tracks developed in farming areas by the wheels of linear and center pivot sprinkler irrigation systems are particularly disruptive to agricultural operations. In addition to slowing field operations and potentially damaging running gear and suspension systems, ruts and tracks will collect rain and irrigation water to further impede equipment traffic in the field. As described above, these problems have spawned a number of creative approaches to their solution, but typically with many shortcomings. The invention disclosed herein ameliorates these problems and offers an effective, efficient and safe method of restoring the soil to its prior undisturbed condition.

This invention of a novel and practical track-filling apparatus comprises a frame, a means for attaching the frame to the tractor, and a soil moving blade assembly mounted to the frame. This blade assembly has laterally disposed and spaced apart left and right blades. A means for adjusting the included blade angle between these blades is also provided. This adjusting means includes a blade adjusting hydraulic ram that is operatively connected to the blades via a novel yet simple and reliable linkage assembly.

Additionally, a means for lifting and tilting the apparatus optimizes and facilitates operation of this invention over irregular and differing terrain, or adjustment of the operating depth of the blades. This also eases the attachment and removal of the device from the tractor.

In operation, the apparatus is mounted to the 3-point hitch of a tractor. The tractor is then positioned over the track or rut to be smoothed, the unit is lowered into the damaged soil to the desired depth and the tractor driven forward over the track. The angle of the blades with respect to each other may be adjusted during use to achieve the desired results and in particular to minimize clogging of the blades from sod, dirt clods and rock accumulations. The tilt of the apparatus may also be adjusted to assist in achieving the same objectives.

These and many other features and attendant advantages of the invention will become apparent, as the invention becomes better understood by reference to the following detailed descriptions and accompanying drawings.

BRIEF DESCRIPTION OF THE DRAWINGS

FIG. 5A is a schematic partial detail view of one embodiment of the top connection for connecting to the three point hitch, including a hydraulic lift ram.

FIG. 5B is a schematic partial detail view of one embodiment of a bottom connection for connecting to the three point hitch, including a hydraulic lift ram.

FIG. 6 is a schematic side view of one embodiment of the invention including a chain or roller drug behind the wheel track filling apparatus.

DESCRIPTION OF THE PREFERRED EMBODIMENTS

Figure 1:
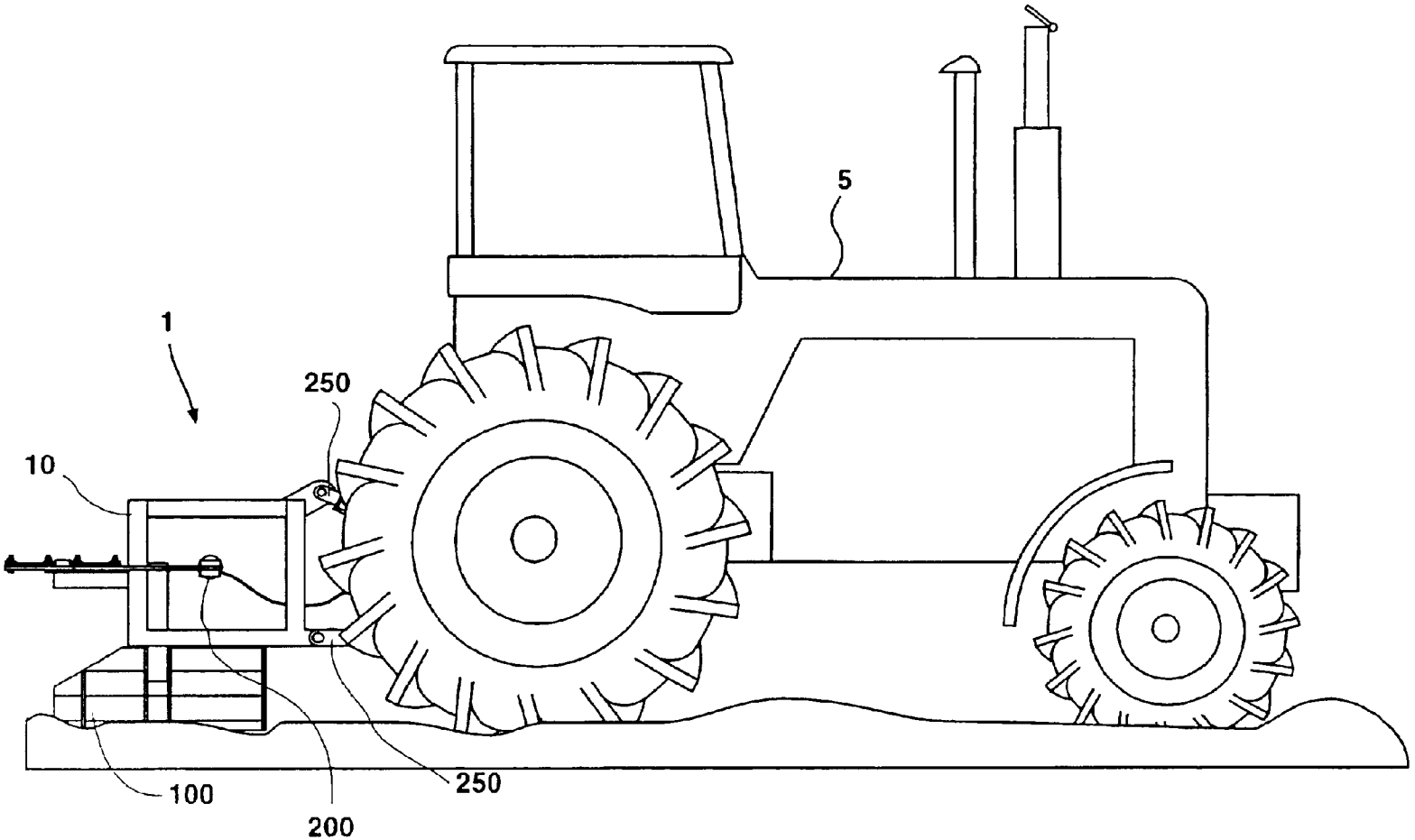
FIG. 1 is a right side view of the invented apparatus connected to a farm tractor.
Figure 2:
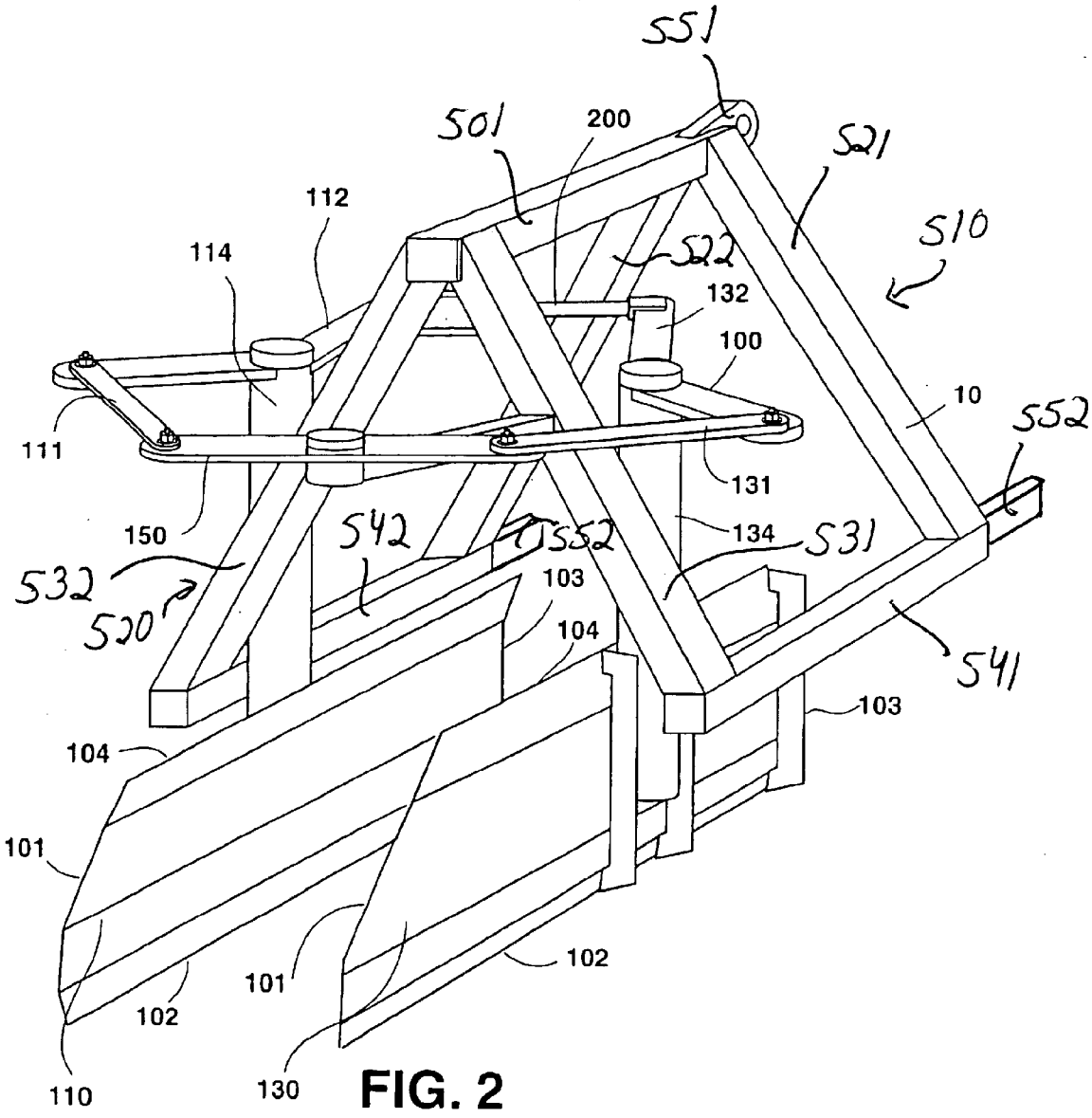
FIG. 2 is an isometric view of the wheel track filling apparatus from the right-rear (i.e. the end not connected to the tractor).

As shown in FIGS. 1 and 2, this invention is of a track-filling apparatus 1 connected to tractor 5 for returning rutted soil displaced by the repeated passage of wheels. This apparatus comprises frame 10, a means for attaching 250 the frame to the tractor and soil moving blade assembly 100 mounted to the said frame. The blade assembly has laterally disposed left and right blades 110, 130. These blades have a spaced apart relationship forming included blade angle 600 there between. Soil moving blade assembly 100 further includes means for adjusting 200 the included blade angle.

Figure 3:
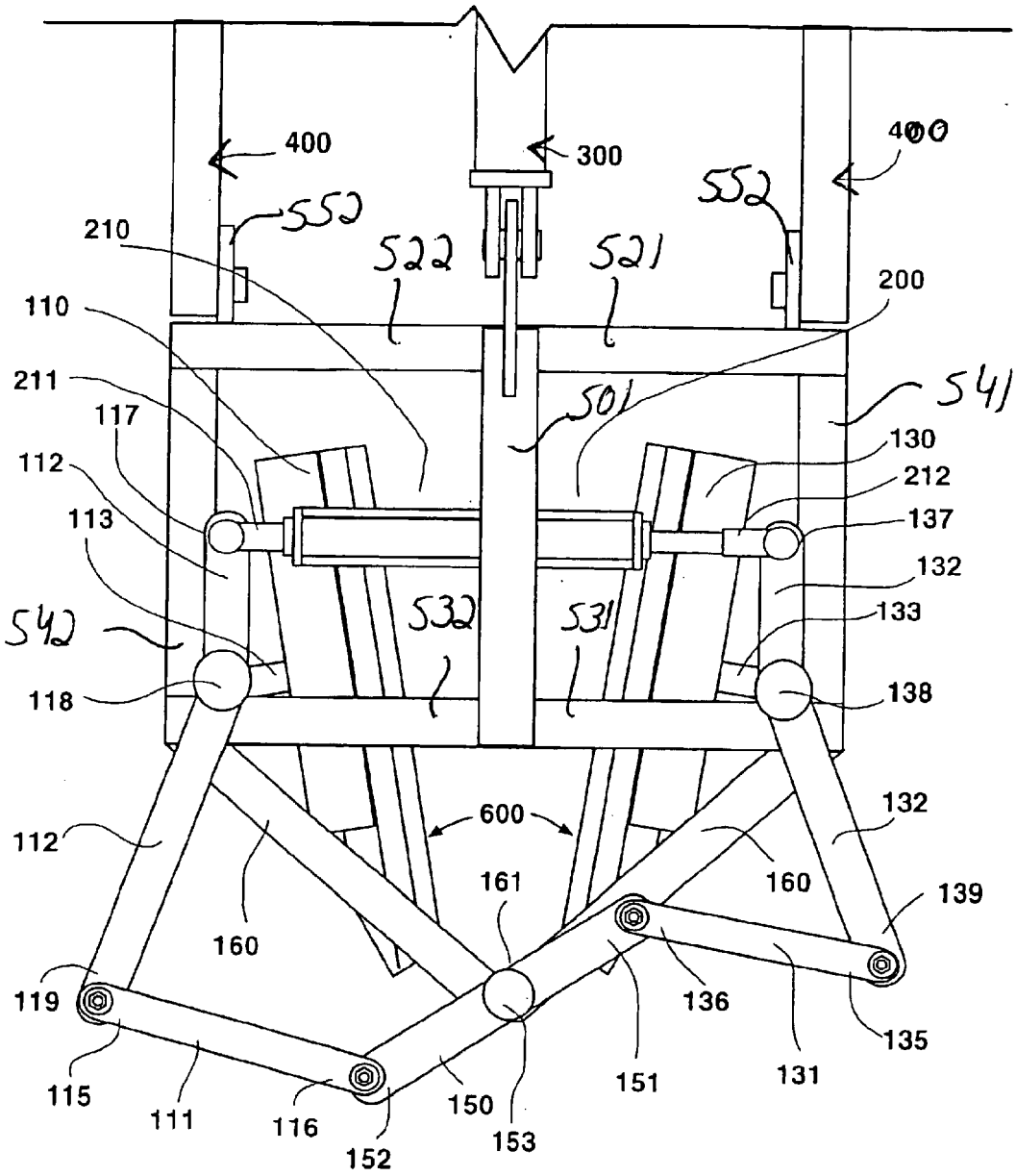
FIG. 3 is a top view of the preferred embodiment of this invention showing the details of the frame and blade assembly with the blades partially closed.
Figure 4:
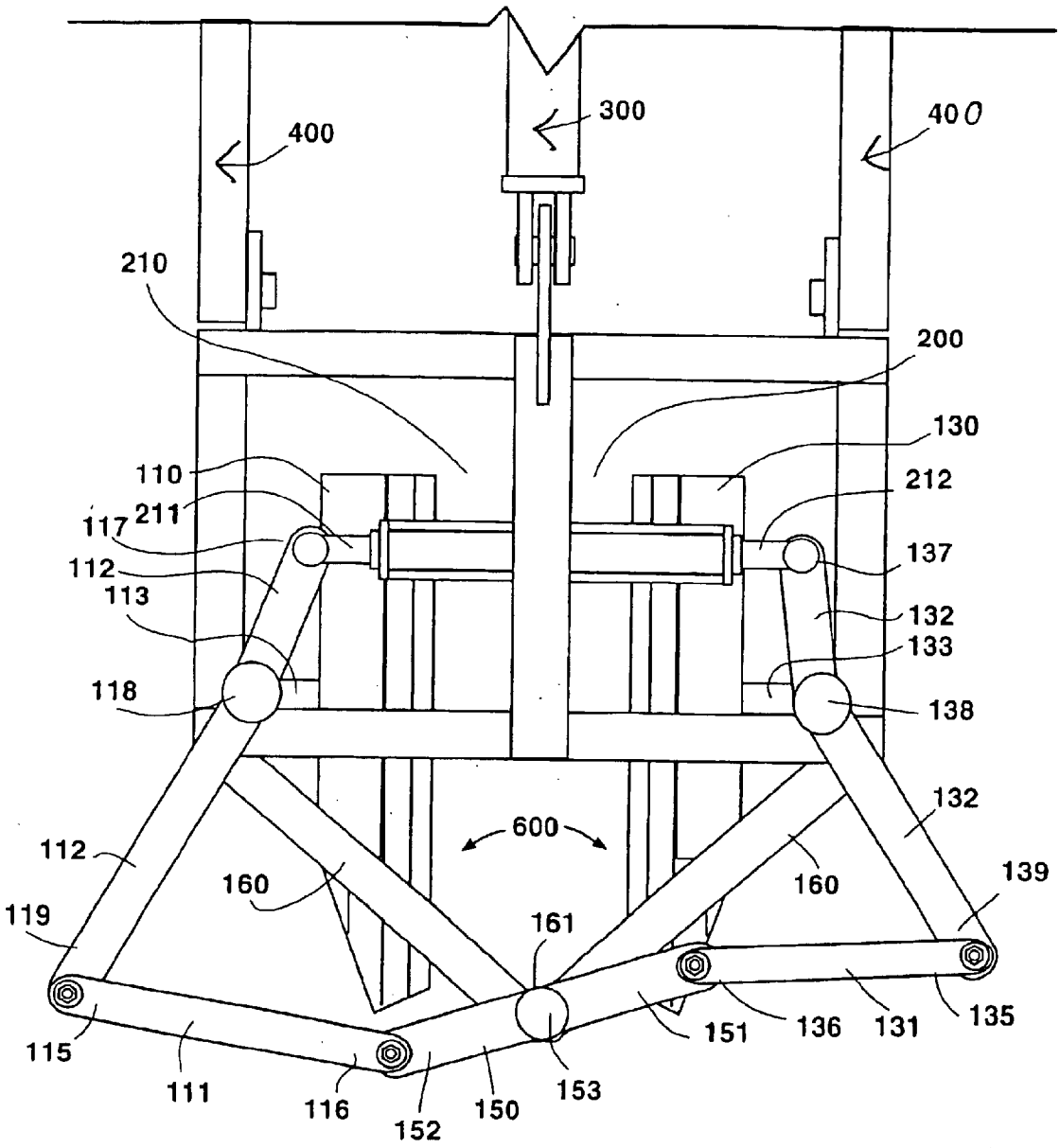
FIG. 4 is a top view of the preferred embodiment of this invention showing the details of the frame and blade assembly with the blades fully open.

Referring now to FIGS. 2, 3 and 4, a critical feature of the preferred embodiment of this invention is the novel design of the means for adjusting 200 the included blade angle. This means includes blade adjusting hydraulic ram 210 having piston end 212 and cylinder end 211. This means for adjusting also includes left and right blade support arms 113, 131 that are fixedly secured to left and right blades 110, 130 respectively. Left and right blade support shafts 114, 134 are pivotably secured in bushing or bearings (not shown) within frame 10. The blade assembly further includes left and right angled pivot bars 112, 132 each having a first end 117, 137, pivot point 118, 138 and second end 119, 139.

Still referring to FIGS. 2, 3 and 4, the blade assembly additionally includes left and right connection bars 111, 131, each having first end 115, 135 and second end 116, 136, tiebar 15 having first end 151, pivot point 153 and second end 152, and tiebar bracket 160 having pivot point 161.

The above described components of the preferred embodiment of this invention are interconnected as follows. Continuing reference to FIGS. 2, 3 and 4, piston end 212 of blade-adjusting ram 210 is pivotably connected to first end 137 of right angled pivot bar 132. Right pivot bar pivot point 138 is fixedly connected to the right blade support shaft 134, which in turn is fixedly secured to right support arm 133. Second end 139 of right pivot bar 132 is pivotably connected to first end 135 of right blade connection bar 131 and second end 136 of right blade connection bar 131 is pivotably connected to first end 151 of tiebar 150. Pivot point 153 of the tiebar is pivotably connected to tiebar bracket pivot point 161.

Continuing reference to FIGS. 2, 3 and 4, second end 152 of the tiebar is pivotably connected to second end 116 of left connection bar 111 and first end 115 of the left connection bar is pivotably connected to second end 119 of left angled pivot bar 112. Left pivot bar pivot point 118 is fixedly connected to left blade support shaft 114, which in turn is fixedly secured to left blade support arm 113. And completing the interconnection of these components, first end 117 of left pivot bar 112 is pivotably connected to cylinder end 211 of blade-adjusting ram 210.

In these figures, FIG. 3 shows blades 110, 130 partially closed by the partial extension of piston end 212 of ram 210. FIG. 4 depicts this invention with piston end 21 fully retracted thus fully opening blades 110, 130 and thus B maximizing the included angle 600.

In the preferred embodiment of this invention, a means for attaching the apparatus to the tractor as well as a means for lifting and a means for tilting the track-filling apparatus are provided. Such means are well known by those skilled and active in the farm equipment field. However, as shown in FIGS. 5A and 5B, means for attaching 250 includes means for lifting 300 and the means for tilting 400, each comprising at least one hydraulic lift ram 310, 410 respectively, and each hydraulic lift ram being separately and pivotably connected between the frame and the tractor.

As shown to best advantage in FIG. 2, the frame 10 is preferably an A-shaped frame, with atop bar 501 and two slanted sides 510, 520. Each of the two slanted sides 510, 520 comprises a front bar 521, 522, a rear bar 531, 532, and a bottom bar 541, 542. As shown in FIG. 2. the preferred front bars 521, 522 form the front extremity of the frame, the preferred rear bars 531, 532 form the rear extremity of the frame, and the preferred bottom bars 541, 542 form the bottom extremity of the frame. As illustrated in the Figures, the preferred member 551 on the top bar 501 at the front extremity of the frame is attached to the top connection (means for lifting 300), which connects to the top point 601 of a three-point hitch. As also illustrated in the Figures, the preferred members 552 on the bottom bars 541, 542 also at the front extremity of the frame are attached to the bottom connections (means for tilting 400), which connect to the bottom points 641, 642 of the three-point hitch.

It is another important feature of the preferred embodiment of this invention that left and right blades 110, 130 are replaceable. As shown in FIG. 2, the left and right blades each have upper edge 104, lower cutting edge 102, forward section 101 and rearward section 103. These blades are tapered from the upper edge rearwardly and downwardly to the cutting edge. This novel tapering of the blades facilitates the discharge of dirt clods, sod accumulations and rocks that might form between the blades.

Blades 110, 130 are readily formed from commercial road grader blades and thus are inexpensive and the materials readily available. The blades are preferably welded to support shafts 114, 134.

In another alternative embodiment shown schematically in FIG. 6, a means for smoothing the soil moved by said blades may be accommodated if necessary. This alternative might be useful should the operator want to smooth or level any small berm that may remain after passage of the blades through the soil. Such means would be attached to the frame in a manner not to interfere with the normal operation of the apparatus. This means 701 may be a heavy chain net dragged behind the blades or a weighted roller supported from a strut pivotably connected to the frame or the tractor. In yet another embodiment (not shown), when certain compacted soil conditions are encountered, additional weight be added to the track-filling apparatus. In such rare cases, weight tractor weights (not shown) may be suspended from brackets welded on each side of the frame so long as these brackets do not interfere with the operation any aspect of the apparatus.

In operation, with reference to FIGS. 1, 2, 3 and 4, apparatus 1 is mounted to the 3-point hitch of tractor 5. Tractor 5 is then positioned over the track or rut to be smoothed and the apparatus is then lowered into the soil to the desired depth of blades. The tractor is then simply driven forward over the track in the damaged soil. If necessary, either of the alternative embodiments offered to increase the penetration depth of the blades or to smooth the soil may be incorporated. In use, the included angle 600 of the blades may be adjusted to achieve the desired results and in particular to minimize clogging of blades from sod, dirt clods and rock accumulations. The means for lifting 300 and the means for tilting 400 may also be used to optimize the overall performance of the apparatus.

Although this invention has been described above with reference to particular means, materials and embodiments, it is to be understood that the invention is not limited to these disclosed particulars, but extends instead to all equivalents within the scope of the following claims.

I claim:

1. A track-filling apparatus connected to a tractor for smoothing rutted soil formed by the repeated passage of wheels, said apparatus comprising:

a frame having a front and a rear, a system for attaching said front of the frame to the tractor, a soil moving blade assembly mounted to said frame, said assembly having laterally disposed left and right blades, said blades further having a spaced apart relationship forming an included blade angle there between, and a system for adjusting said included blade angle by changing said spaced relationship of the left and right blades, said system for adjusting comprising:

a tiebar being pivotal on a tiebar pivot point near said rear of the frame, left and right arm systems each comprising a plurality of arm segments pivotally connected to each other, and each of said left and right arm systems having a rear portion pivotally connected to the tiebar and having a front portion near said front of the frame, wherein the left blade is fixed to said left arm system and wherein the right blade is fixed to said right arm system, a blade adjusting hydraulic ram extending between said front portions of the left and right arm systems and adapted to pull said front portions together to move the left and right blade to be generally parallel to each other, and to push said front portions apart to move the left and right blade to said included blade angle relative to each other.

2. A track-filling apparatus according to claim 1 wherein said system for attaching said frame to the tractor includes a system for lifting and a system for tilting said track-filling apparatus.

3. A track-filling apparatus according to claim 2 wherein said system for lifting comprises at least one hydraulic lift ram pivotably connected between said front of the frame and said tractor.

4. A track filling apparatus according to claim 2 wherein said system for tilting comprises at least one hydraulic tilt ram, said tilt rain being pivotably connected between said front of the frame and said tractor.

5. A track filling apparatus according to claim 1 wherein said left and right blades are replaceable.

6. A track filling apparatus according to claim 1 wherein said left and right blades each have an upper edge, a lower cutting edge, said blades being tapered from the upper edge rearwardly and downwardly and to the cutting edge.

7. A track filling apparatus according to claim 1 wherein said left and right blades comprise road grader blades.

8. A track filling apparatus according to claim 1 wherein said apparatus further includes a system for smoothing the soil moved by said blades.

9. A track-filling apparatus as in claim 1, wherein the system for attaching said front of the frame to the tractor includes three connections adapted to connect to a three-point hitch of the tractor, the three connections being a top connection and two bottom connections, wherein the top connection comprises a hydraulic ram.

10. A track-filling apparatus as in claim 1, wherein the system for attaching said front of the frame to the tractor includes three connections adapted to connect to a three-point hitch of the tractor, the three connections being a top connection and two bottom connections, wherein the two bottom connections each comprises a hydraulic ram.

11. A track-filling apparatus connected to a tractor for smoothing rutted soil formed by the repeated passage of wheels, said apparatus comprising:

a frame, a system for attaching said frame to the tractor, and a soil moving blade assembly mounted to said frame, said assembly having laterally disposed left and right blades, said blades further having a spaced apart relationship forming an included blade angle there between, wherein said soil moving blade assembly further includes a system for adjusting the included blade angle, wherein said system for adjusting the included blade angle includes:

a blade adjusting hydraulic ram having piston and cylinder ends, left and right blade support arms fixedly secured to the left and right blades respectively, left and right blade support shafts, each shaft being pivotably secured within said frame and fixedly secured thereto, the left support shaft being fixedly secured to the left blade and the right support shaft being fixedly secured to the right blade, left and right angled pivot bars each having a first end, a pivot point and a second end, left and right connection bars, each having first and second ends, a tiebar having a first end, a pivot point and a second end, and a tiebar bracket having a pivot point, wherein:

the piston end of the blade-adjusting ram is pivotably connected to the first end of the right angled pivot bar, the right bar pivot point is fixedly connected to the right blade support shaft, the second end of the right pivot bar is pivotably connected to the first end of the right connection bar and the second end of the right connection bar is pivotably connected to the first end of the tiebar, the pivot point of the tiebar is pivotably connected to the tiebar bracket pivot point, the second end of the tiebar is pivotably connected to the second end of the left connection bar, the first end of the left connection bar is pivotably connected to the second end of the left angled pivot bar, the left pivot bar pivot point is fixedly connected to the left blade support shaft, and the first end of the left pivot bar is pivotably connected to the cylinder end of the blade-adjusting ram.

12. A track-filling apparatus according to claim 11 wherein said a system for attaching said frame to the tractor includes a system for lifting and a system for tilting said track-filling apparatus.

13. A track-filling apparatus according to claim 12 wherein said system for lifting comprises at least one hydraulic lift ram pivotably connected between said front of the frame and said tractor.

14. A track filling apparatus according to claim 12 wherein said system for tilting comprises at least one hydraulic tilt ram, said tilt ram being pivotably connected between said front of the frame and said tractor.

15. A track filling apparatus according to claim 11 wherein said left and right blades are replaceable.

16. A track filling apparatus according to claim 11 wherein said left and right blades each have an upper edge, a lower cutting edge, said blades being tapered from the upper edge rearwardly and downwardly and to the cutting edge.

17. A track filling apparatus according to claim 11 wherein said left and right blades comprise road grader blades.

18. A track filling apparatus according to claim 11 wherein said apparatus further includes a system for smoothing the soil moved by said blades.

* * * * *